United States Patent [19]

Bonin

[11] 4,154,204

[45] May 15, 1979

[54] FUEL INJECTION PUMP RESPONSIVE TO AN ENGINE'S INTAKE AIR PRESSURE

[75] Inventor: Jean-Claude Bonin, Blois, France

[73] Assignee: CAV RotoDiesel, Blois, France

[21] Appl. No.: 821,500

[22] Filed: Aug. 3, 1977

[30] Foreign Application Priority Data

Aug. 9, 1976 [FR] France ..... 76 24255

[51] Int. Cl.[2] ..... F02M 39/02; F02D 1/06

[52] U.S. Cl. ..... 123/139 AQ; 123/140 MP; 417/462

[58] Field of Search ..... 123/139 AB, 139 AC, 123/139 AD, 139 AQ, 139 AR, 140 FG, 140 MP; 417/462, 221, 218

[56] References Cited

U.S. PATENT DOCUMENTS

| | | | |
|---|---|---|---|
| 3,771,506 | 11/1973 | Davis | 123/139 AQ |
| 3,910,723 | 10/1975 | Bonin | 417/462 |
| 3,960,126 | 6/1976 | Shinoda | 123/140 MP |

FOREIGN PATENT DOCUMENTS

| | | | |
|---|---|---|---|
| 814811 | 9/1951 | Fed. Rep. of Germany | 123/140 FG |
| 933962 | 10/1955 | Fed. Rep. of Germany | 123/140 FG |
| 1158318 | 8/1959 | Fed. Rep. of Germany | 123/140 MP |

*Primary Examiner*—Charles J. Myhre
*Assistant Examiner*—P. S. Lall
*Attorney, Agent, or Firm*—Finnegan, Henderson, Farabow & Garrett

[57] ABSTRACT

A fuel injection pump for an internal combustion engine comprises a rotor, a pair of plungers located in a transverse bore formed in the rotor and to which inward movement is imparted by roller shoes which support respective rollers engaged by a cam ring having cam lobes on its internal periphery.

The roller shoes are engageable by stop members, the roller shoes and stop members having complementary surfaces with a continuous and/or discontinuous profile thereby to allow variation of the maximum fuel amount delivered to the engine. The roller shoes are axially displaceable by hydraulic driving means fed by a pressure which is made dependent on the air pressure introduced into the engine by a valve comprising a piston slidable in a cylinder and subject to the action of air pressure responsive means and a discharge port the effective section of which is adjustable by the position of the piston.

3 Claims, 6 Drawing Figures

FUEL INJECTION PUMP RESPONSIVE TO AN ENGINE'S INTAKE AIR PRESSURE

The invention relates to fuel injection pumps for supplying fuel to an internal combustion engine and particularly to a diesel engine.

Fuel injection pumps are known which comprise a housing, a rotor mounted for rotation within the housing and arranged to be driven in timed relationship with an associated engine, a transverse bore in the rotor, a pair of plungers disposed in said bore, passage means for allowing flow of fuel to and from said bore, a cam ring surrounding said rotor, cam lobes formed on the internal periphery of the cam ring, a pair of rollers engaging the internal periphery of the cam ring, roller shoes for respectively supporting said rollers, said rollers shoes being rotatable with the rotor and engaging the outer ends of the plungers whereby as the rotor rotates, an inward movement is imparted to the plungers, stop means for limiting the outward movement of the plungers, said roller shoes being operable to move axially relative to said stop means, at least two different relative axial positions corresponding to different outermost positions of the plungers.

In a known embodiment of such a pump, each roller shoe comprises a side portion for engagement with a radially adjustable stop member, secured to said rotor, the roller shoes and said stop members having complementary contact surfaces with a continuous and/or discontinuous profile in the axial direction. Any relative axial displacement of a roller shoe to its respective stop member thus results in variation of the maximum outward movement of the plungers, and therefore of the maximum fuel amount delivered to the engine.

Moreover, in this embodiment, the roller shoes are carried by a carriage axially slidable on the rotor, said carriage being subject to the action of resilient biasing means and to the action in reverse direction of hydraulic driving means supplied by a pressure depending on one or more of the operating engine parameters.

The object of the invention is to provide a pump of the described type which is particularly suitable for supplying a supercharged engine, that is an engine equipped with a supercharger which compresses the comburent air before being admitted inside the cylinders. In such an engine, since a larger amount of air is admitted, it is advantageous to increase the fuel amount supplied to the engine. The air pressure introduced in the engine is then a significant parameter which has to be taken in account to determine the pressure operating the drive means of the carriage.

In the injection pump according to the invention, there is provided a valve comprising a first cylinder, a piston slidably mounted in the cylinder and defining a chamber, a pressure source connected to said chamber via a jet, a discharge port the effective area of which is adjustable by the position of the piston, a conduit connecting said chamber to said hydraulic driving means, a resilient member acting on the piston and means responsive to the air pressure introduced in the associated engine, opposing the action of said resilient member.

Preferably, said means responsive to the air pressure comprise a second cylinder separated from the first cylinder by a fluid-tight element, a flexible diaphragm secured at the inner periphery of to said second cylinder and dividing said second cylinder into two chambers of which one is kept at a constant pressure and the other of which receives the air pressure introduced in the engine, and a rigid rod connecting the piston to said flexible diaphragm.

The invention will become more apparent from the following description taken in conjunction with the accompanying drawing wherein.

Figure 1:
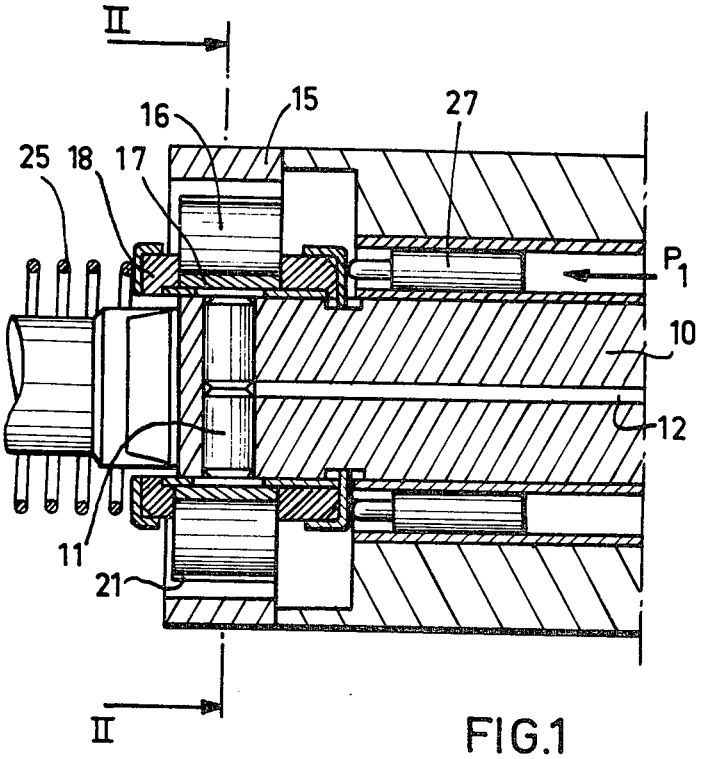
FIG. 1 is a schematic axial view of a pump with axially movable shoes.

The pump shown in FIG. 1 comprises a housing in which is rotatably mounted a rotor 10 formed with a transverse bore accommodating two opposed sliding plungers 11. The transverse bore communicates with a passage 12 for the intake and delivery of the fuel.

Figure 2:
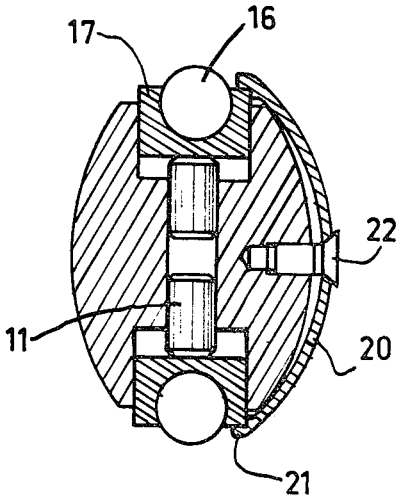
FIG. 2 is a partial cross-sectional view along line II-II of FIG. 1.

The inward movement of the plungers 11 is effected by a fixed cam ring 15 having formed on its internal periphery cam lobes which are engaged, as the rotor rotates, by rollers 16. The rollers 16, shown in detail in FIG. 2, are supported in respective roller shoes 17 acting as centrifugal stops for plungers 11. The operation of pumps of said type is well known and needs not to be described here. The roller shoes 17 are mounted on a carriage 18 arranged for sliding motion parallel to the axis of the rotor 10, and are therefore axially displaceable. The outward displacement of the shoes 17, as fuel admission takes place, is limited by radial stops formed by the end portions 21 of a flexible blade 20 secured to the rotor 10 by means of an adjustment screw 22. Screw 22 provides adjustment for the deflection of blade 20 and therefore the radial position of its end portions 21.

Figure 4A:
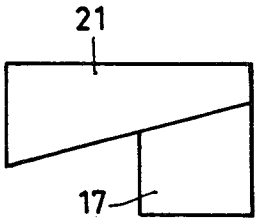
FIGS. 4*a* to 4*c* illustrate various axial positions which may be assumed by the shoes with respect to the stop members.
Figure 4B:
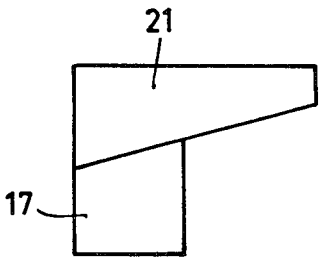
Figure 4C:
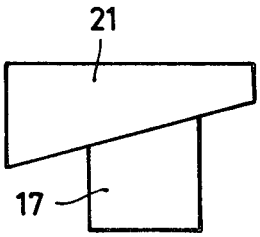

As may be seen in FIGS. 4*a* to 4*c*, the flexible blade end portions 21 and the shoes 17 are formed with continuously inclined contact surfaces which form complementing variable profiles along the axial direction. The delivery stroke of the plungers 11, and therefore the maximum fuel amount supplied to the engine may thus be varied continuously by moving the shoes 17 axially with respect to the end portions 21.

The carriage 18 which carries the shoes 17 is subject on the one hand to the action of a compression spring 25 mounted around the pump shaft and on the other hand to the action in reverse direction of the hydraulic jacks 27.

Figure 3:
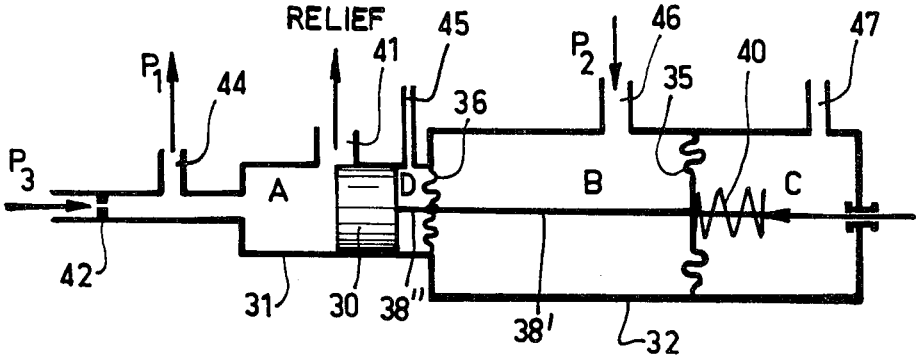
FIG. 3 shows schematically the valve for controlling the position of the shoes.

The hydraulic pressure $P_1$ operating on jacks 27 is supplied by a valve, schematically shown in FIG. 3. This valve allows, as will be explained hereafter, the air pressure $P_2$ of the comburent compressed air introduced in the engine to be used as a control parameter for the position of carriage 18 and therefore the maximum fuel amount delivered to the engine.

The valve shown in FIG. 3 comprises a piston 30 sliding inside a cylinder 31 provided with a port 41 in front of which the edge of piston 30 moves, a second cylinder 32 of larger diameter inside which a flexible diaphragm 35 is secured to the inner periphery of the cylinder 32. A second flexible diaphragm 36 separates cylinders 31 and 32. Diaphragm 35 is connected to piston 30 by a rod comprising a section 38' connecting diaphragm 35 to diaphragm 36 and a section 38'' connecting diaphragm 36 to piston 30. Diaphragm 35 is biased towards the piston by a compression spring 40 mounted about an extension of rod 38.

The assembly thus described defines chambers A and D in cylinder 31 respectively to the left hand side and to the right hand side of piston 30, and chambers B and C in cylinder 32 respectively to the left hand side and to the right hand side of diaphragm 35.

Chamber A is connected via a jet spray nozzle 42 to the internal hydraulic pressure $P_3$ of the pump. Chamber A further and comprises a pipe 44 for collecting pressure $P_1$ existing in chamber A.

Port 41 which may be closed off by piston 30 is connected to a constant pressure source acting as a relief.

Chamber D defined between piston 30 and diaphragm 36 communicates via a port 45 with a constant hydraulic pressure source acting as leakage catcher. Said port 45 can never be closed off by piston 30.

The pressure prevailing in chamber B is the pressure $P_2$ of the air introduced in the engine, which flows via pipe 46. Finally, chamber C is connected via a port 47 to a constant pressure source. It should be understood that diaphragm 36 provides a seal between the fuel present in cylinder 31 and the air present in cylinder 32.

The axial position of piston 30, which affects the value of output pressure $P_1$, is determined by the pressure difference between chambers B and C. If $P_2$ increases, the piston moves towards the right and further uncovers port 41, resulting in a decrease of $P_1$. The value of pressure $P_1$ is therefore $P_1 = P_o - \alpha P_2$, with Po depending on the rate of spring 40 and $\alpha$ being a positive constant.

The value of pressure $P_1$, which controls jacks 27 which in turn actuate carriage 18, is therefore a function of pressure $P_2$ of the air introduced in the engine. Pressures $P_1$ and $P_2$ vary inversely. As the value of $P_1$ defines the axial position of the shoes 17, the maximum fuel amount supplied to the engine, determined by the axial position of the shoes, is made dependent on the filling pressure $P_2$ of the comburent, compressed air introduced into the engine.

The interrelationship of the fuel flow and the filling pressure of the engine is particularly significant in the case of a supercharged engine since an increase of the fuel amount delivered to the engine should normally take place as the air pressure rises due to the supercharging. The invention fulfills this requirement since the filling pressure of the engine is taken in account as a control parameter for the position of the shoes 17. This will be explained now with reference to FIGS. 4*a* to 4*c* corresponding to different stages of the engine operation.

At the start of the engine, pressure $P_1$ is zero and the shoes 17 are in the position shown in FIG. 4*a* where the stroke of pistons 11 is maximum (supercharging).

After starting, pressure $P_1$ which acts on jacks 27 is regulated by piston 30 and equals $P_1 = P_o(P_2=0)$ and the shoes are in the position shown in FIG. 4*b* where pistons 11 are at the minimum distance from each other. The fuel pump therefore supplies a minimum amount of fuel to the engine.

When the air pressure $P_2$ varies, pressure $P_1$ varies in reverse direction, and this variance affects the position of the shoes 17. Shoes 17 then assume an axial position defined by the balance between the force exerted by pressure $P_1$ upon the hydraulic jacks 27 and the force of spring 25, as shown in FIG. 4*c*.

It will be understood that in FIGS. 4*a* to 4*c*, an increase of $P_1$ causes a displacement of the shoes 17 towards the left, and therefore a decrease of the fuel amount supplied to the engine. The increase of $P_2$ decreases $P_1$ and therefore causes increase of the maximum fuel amount supplied to the engine.

Although, in the present description, there has been mentioned only $P_2$ as operating parameter acting on pressure $P_1$, it is clear that in practice other parameters will be taken in account, such as the speed and the load of the engine, the action of which will be superimposed to that of the filling pressure $P_2$.

What I claim is:

1. A fuel injection pump for supplying fuel to an associated internal combustion engine comprising:

a housing, a rotor mounted for rotation within the housing and arranged to be driven in timed relationship with the associated engine, a transverse bore in the rotor, a pair of plungers disposed in said bore, passage means for allowing flow of fuel to and from said bore, a cam ring surrounding said rotor, cam lobes formed on an internal periphery of said cam ring, a pair of rollers engaging the internal periphery of said cam ring, roller shoes for respectively supporting said rollers, said roller shoes being rotatable with said rotor and engaging the outer ends of said plungers whereby as said rotor rotates an inward movement will be imparted to said plungers, stop means for limiting the outward movement of said plungers, a radially adjustable stop member secured to said rotor, said roller shoes and said stop member being movable relative to one another along the rotor's axis and having contact surfaces with complementing variable profiles along said rotor's axial direction, whereby the relative axial movement of said roller shoes with respect to said stop member varies the outermost position of said plungers, a carriage carrying said roller shoes and being axially slidable on said rotor along the rotor's axis, a first resilient means for biasing said carriage in one axial direction, a hydraulic driving means for biasing said carriage in the opposite axial direction, a first cylinder, a piston slidably mounted in said first cylinder, a chamber defined by said first cylinder and said piston, a pressure source connected to said chamber via a jet, a discharge port in the first cylinder, the effective area of which varies with the position of the piston, a conduit connecting said chamber to said hydraulic driving means, a second resilient means acting on said piston opposite to said pressure source, a second cylinder sealingly separated from said first cylinder by a fluid tight element, a flexible diaphragm secured to said second cylinder and dividing said second cylinder into two chambers, one of which is subject to a constant pressure and the other of which receives the air pressure of the comburent air introduced in the engine, and a rigid rod connecting the piston to said flexible diaphragm.

2. A pump according to claim 1, wherein said fluid tight element is a second flexible diaphragm.

3. A pump according to claim 1 wherein the pressure source connected to said chamber via a jet comprises the fuel being pumped by the fuel pump.

* * * * *